United States Patent [19]

Rosengren

[11] Patent Number: 4,717,144

[45] Date of Patent: Jan. 5, 1988

[54] ARRANGEMENT FOR COLLECTING SEQUENTIALLY TRANSPORTED SHEET-LIKE OBJECTS

[75] Inventor: Rolf Rosengren, Skarholmen, Sweden

[73] Assignee: Inter Innovation AB, Stockholm, Sweden

[21] Appl. No.: 903,612

[22] Filed: Sep. 4, 1986

[30] Foreign Application Priority Data

Nov. 13, 1985 [SE] Sweden ..... 8505366

[51] Int. Cl.[4] ..... B65H 29/54

[52] U.S. Cl. ..... 271/307; 271/181

[58] Field of Search ..... 271/177, 180, 181, 303, 271/305, 307

[56] References Cited

U.S. PATENT DOCUMENTS

| | | | |
|---|---|---|---|
| 2,718,965 | 9/1955 | Cundall | 271/305 X |
| 3,224,757 | 12/1965 | Parke | 271/180 X |
| 3,674,143 | 7/1972 | Hunter | 271/305 X |
| 4,474,366 | 10/1984 | Reider | 271/181 |

*Primary Examiner*—Richard A. Schacher

*Attorney, Agent, or Firm*—Sughrue, Mion, Zinn, Macpeak and Seas

[57] ABSTRACT

An arrangement for collecting sequentially transported bank notes includes two endless belts (21, 22) and a collecting chamber (1) having a plurality of movable flaps (3, 4) spaced sequentially in the direction of transport and briefly swung out simultaneously to displace each bank note to one side of the chamber. The flaps swing when 4/5ths of an incoming bank note are located in the chamber, and may also be arranged to swing out a second time after a predetermined interval. The lower flaps (3) are smaller than but similar in configuration to the upper flaps (4).

9 Claims, 3 Drawing Figures

ARRANGEMENT FOR COLLECTING SEQUENTIALLY TRANSPORTED SHEET-LIKE OBJECTS

TECHNICAL FIELD

The present invention relates to an arrangement for collecting sequentially transported sheet-like objects. The arrangement includes transport means effective for transporting the objects, one at a time, to a collecting chamber and comprises two mutually co-acting parts, e.g. two mutually adjacent endless belts.

BACKGROUND PRIOR ART

It is known to use in conjunction with arrangements for collecting together sheet-like objects, e.g. bank notes, so-called "stacker wheels", i.e. arcuate segments attached to the hub of the wheel and extending to the periphery thereof. The sequentially transported bank notes which are normally advanced in the direction of one longside thereof, i.e. in the direction of the short axis, are normally picked-up by a plurality of stacker wheels mounted on a common axis, and are delivered by said wheels to a collecting station located on the output side of the wheels. This is a convenient method of slowing down the bank notes which are often transported through the apparatus at a relatively high speed. One disadvantage with known stacker wheels, however, is that they take up a relatively large amount of space and consequently often constitute an inconvenience, particularly when handling bank notes of larger sizes, and also in the case of apparatus of the kind in which the bank notes are transported lengthwise, i.e. in the direction of their short axes.

The object of the present invention is to provide an arrangement which will effectively slow down series of sequentially transported sheet-like objects, such as bank notes, cheques, etc. with reduced risk of so-called pile-ups and of damage to said objects as a result thereof, and which will enable a well-collected and compact bundle of bank notes to be obtained. A further object of the invention is to provide an arrangement of the aforesaid kind which requires but little space and which will not therefore constitute an obstacle to the smooth working of other mutually co-acting components. Still another object of the invention is to provide an arrangement which is particularly suited for use in conjunction with relatively thin ("flimsy") sheet-like objects, e.g. very thin bank notes, both with respect to an individual bank note under transportation and to bank notes which have already been bundled in relation to further incoming bank notes.

SUMMARY OF THE INVENTION

An arrangement constructed in accordance with the invention is provided in the immediate vicinity of the collecting chamber with a plurality of readily moveable flaps which are arranged sequentially in the direction of transportation and which are constructed to briefly swing-out simultaneously into the collecting chamber, with each passing object, thereby to move respective objects to one side in the collecting chamber and therewith to provide space for the next following object.

These and further characteristics of the invention are set forth in the following claims.

BRIEF DESCRIPTION OF THE DRAWINGS

The invention will now be described in more detail with reference to the accompanying schematic drawings, in which.

PREFERRED EMBODIMENT OF THE INVENTION

Figure 1:
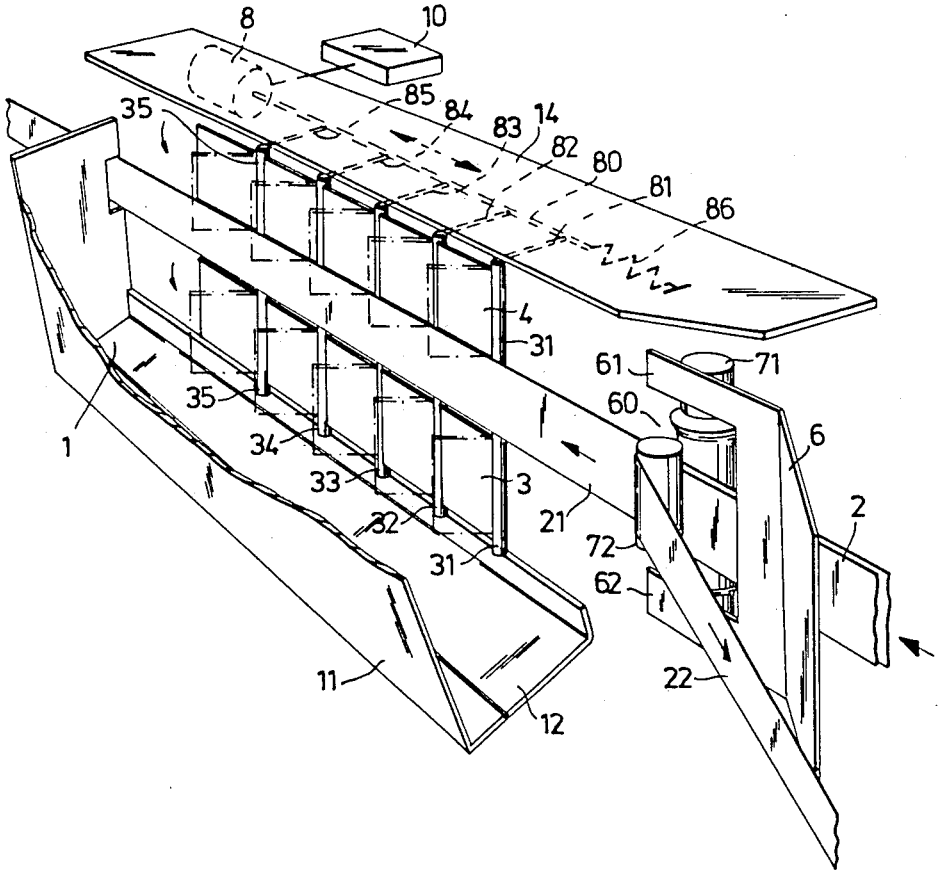
FIG. 1 is a perspective view of an arrangement according to the invention.

The arrangement illustrated in FIG. 1 includes a collecting chamber 1 and a transport means 2, which comprises two endless belts 21 and 22. The belts extend parallel with and adjacent to one another between a location (not shown) to the right of the illustrated arrangement and a pair of mutually co-acting rollers 71–72. The belt 22 lies against the roller 72 and is caused to change direction, whereas the belt 21 continues to move in one and the same direction, past the collecting chamber 1.

Arranged along the collecting chamber 1 and beneath the belt 21 is a first plurality of readily moveable flaps 3 (five in number) which are mounted on rotatable shafts 31–35, while a second plurality of moveable flaps 4 (five in number) are mounted on the upper portions of respective shafts 31–35 in the upper part of the arrangement above the belt 21.

The upper part of the arrangement is defined by a plate 14 forming part of the apparatus incorporating the arrangement according to the invention. Arranged beneath the plate 14 is a solenoid or draw-magnet 8 having a link 80 which is connected mechanically to one end of arms 81–85 which, in turn, are each connected mechanically to a respective shaft 31–35. The distal end of the link 80 is connected mechanically to a tension or draw spring 86, which in the absence of current to the magnet 8 holds the arms 81–85, and therewith also the flaps 3 and 4, in the illustrated positions shown in full lines, i.e. positions in which the flaps extend parallel with the belt 21.

The solenoid or draw-magnet 8 is controlled by a computer 10, and when current is passed to the magnet it draws the link 80 and therewith the arms 81–85, so as to rotate the shafts 31–35 anticlockwise, whereupon the flaps 3 and 4 are swung simultaneously and briefly into the collecting chamber 1 to the positions shown in broken lines. Immediately upon disconnecting the current to the magnet 8, the spring 86 withdraws the link system back to its original starting position, therewith moving the flaps back to their respective positions shown in full lines in FIG. 1.

When, for example, a bank note enters the collecting chamber 1 together with the belt 21, the outwardly swinging flaps engage the bank note and move it to the left-hand side of the collecting chamber 1 (as illustrated), therewith providing space for the next bank note in line.

Arranged in the immediate proximity of the pair of rollers 71–72 is a bifurcate guide plate 6, which presents an aperture 60 between two mutually opposed legs 61 and 62. The contact surface between the rollers 71 and 72 lies within the aperture 60, and the guide plate is so positioned that the incoming parts of the belts 21 and 22 both pass to the right of the plate 6 prior to reaching the pair of rollers 71,72.

Thus, a bank note transported by the transport means 2 enters from the right between the two belts 21 and 22, as indicated by the double arrows, and is prevented from accompanying the belt 22 by the legs 61 and 62 of the plate 6 located in the vicinity of the roller pair 71 and 72, and as a result of the sub-pressure prevailing between the bank note and the belt 21 will instead accompany the belt 21 into the collecting chamber 1. When the bank note reaches a position approximately adjacent the shaft 35 (i.e. the leading edge of the bank note) all flaps are swung outwards so as to displace the bank note towards a slightly inclined left-hand wall 11 of the chamber 1. The flaps are then immediately swung back to their starting positions, whereupon the arrangement is in readiness for receiving the next bank note in line.

Figure 2:
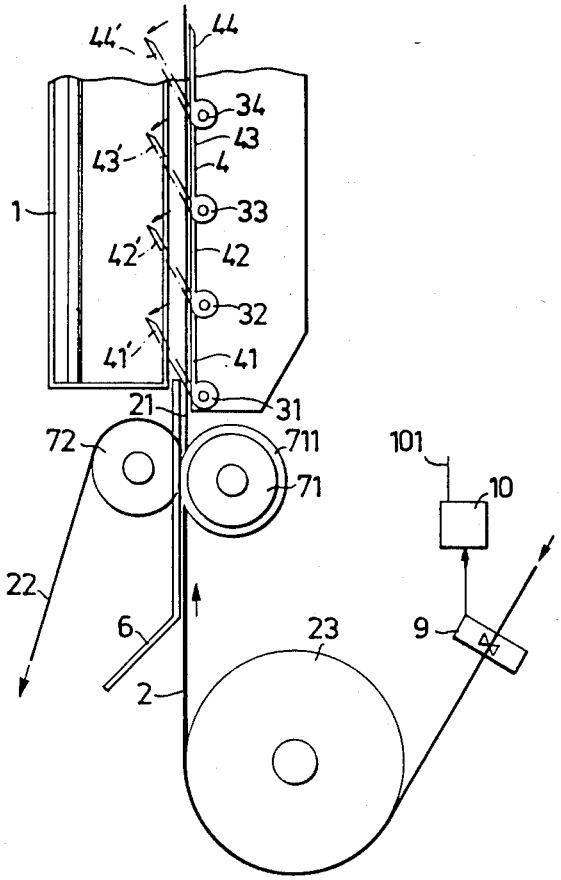
FIG. 2 is a top plan view of part of the arrangement illustrated in FIG. 1.

FIG. 2 illustrates the second plurality of flaps 4 in full lines, here referenced 41–44, and in broken lines, (i.e. in their outwardly swung positions) here referenced 41'–44'. The transport means 2, comprising the two belts 21 and 22, is arranged to pass a sensor 9, which is connected to a computer 10, and is subjected to a directional change of about 150° prior to arriving at the guide plate 6 and entering the pair of rollers 71–72. The roller 71 is provided with two flanges, of which the upper flange is shown in FIG. 2 and referenced 711. This upper flange extends slightly over the periphery of the roller 72.

When a bank note is transported by the transport means 2 towards the collecting chamber 1, the bank note will first pass the sensor 9 which, upon detecting the leading edge of the bank note, sends a signal to the computer 10, thereby activating an electronic time counter incorporated in the computer. The time taken to advance the bank note to the last flap in the two pluralities of flaps 3 and 4 can be accurately calculated on the basis of the speed of the transport means and the distance from the sensor 9 to approximately the last flaps in said pluralities of flaps 3 and 4, the result of this calculation being incorporated as a constant in the computer 10. Subsequent to the time counter (pulse clock) counting to a time value which equals the aforesaid constant, assumed to take place at a time point t1, the computer 10 sends a signal to the magnet 8 on an output 101, causing the magnet to draw and swing-out the flaps 3 and 4 in a manner to displace the bank note towards the wall 11 of the collecting chamber 1.

Figure 3:
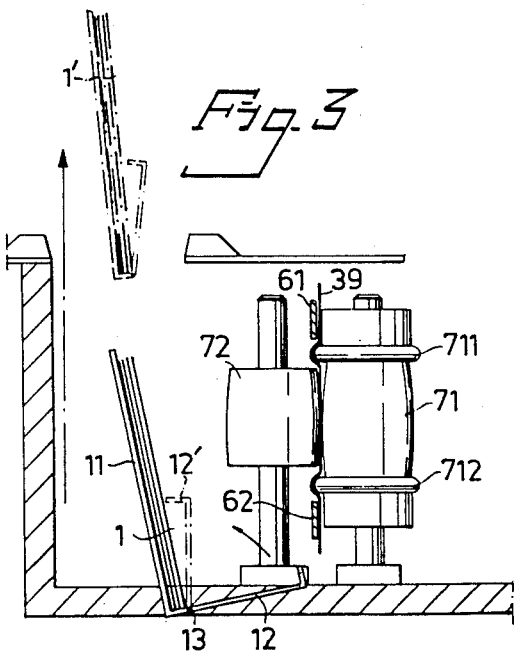
FIG. 3 illustrates in side view a number of the components of the arrangement illustrated in FIGS. 1–2.

It will be seen from FIG. 3 that the roller 71 has a relatively long axial extension, and that the extremities of the roller are located close to the legs 61 and 62 of the bifurcate guide plate 6. It will also be seen from FIG. 3 that the flanges 711 and 712 on the roller 71 are each placed immediately beneath and immediately above a respective leg 61 and 62. The roller 72 is shorter than the roller 71 and its peripheral surface is located between the flanges 711 and 712, closely adjacent the peripheral surface of the roller 71. For the sake of illustration, the belts 21 and 22 have been omitted from the FIG. 3 illustration, although a bank note 39 has been shown. As will be seen, due to the relative configuration and positioning of the rollers 71 and 72, and of the bifurcate guide plate 6 with legs 61 and 62, the bank note 31 will be corrugated or pleated slightly upon being transported into the collecting chamber 1. More generally, it can be said that the roller 71 shall have one or more outwardly bulging portions or inwardly curved portions corresponding to the inwardly curved and outwardly bulging portions of the guide plate 6 or corresponding to similar spaces in the combination guide plate 6 - roller 72.

In addition to the aforementioned inclined wall 11 the collecting chamber 1 also includes a bottom 12 which can be rotated upwards about a horizontal axis 13, from the position shown in full lines to the position 12' shown in broken lines. In its upwardly rotated position the bottom 12' forms a wall opposed to the inclined wall 11 in the collecting chamber. In the illustrated embodiment it is assumed that subsequent to collecting a given number of bank notes in the chamber 1, the chamber is moved upwards in a known manner to a position 1' in which the bank notes are accessible externally to a customer, cashier or like person. Subsequent to removing the bundle of bank notes from the chamber 1', the chamber is moved down to its original starting position and the bottom is swung down from its raised position 12' to its original position 12. The arrangement is therewith ready to receive further bank notes via the transport means 2.

The inclined wall of the collecting chamber ensures that bank notes which have already entered the collecting chamber 1 are positioned roughly as indicated in FIG. 3, i.e. will lean against the wall 11. It is possible, however, that for some reason or other—e.g. due to slovenly handling of the bank notes—one or more bank notes will become spread-out in the chamber 1 to a greater or lesser extent, instead of remaining in the given position. In order to rectify this, or to safeguard against such an eventuality, the computer 10 is suitably programmed to cause the flaps 3 and 4 to swing-out at a second point in time t2 which exceeds by a given length of time the firstmentioned time point t1 at which the flaps 3 and 4 were last swung-in, even in the absence of a bank note to the collecting chamber.

The flaps incorporated in the first plurality of flaps 3 are preferably smaller in size than the flaps incorporated in the second plurality of flaps 4, although of the same configuration as said flaps 4, e.g. have the form of a trapezium with one of the non-parallel sides extending vertically and the upper of the parallel sides being longer than the lower.

I claim:

1. An apparatus for collecting sequentially transported sheet-like objects, comprising: a collecting chamber (1), transport means (2) arranged to transport the objects to said collecting chamber one at a time and including two mutually co-acting members (21, 22), a first plurality of substantially planar flaps (41–44) sequentially disposed in a direction of transport of said objects and substantially parallel thereto adjacent the collecting chamber and the transport means, means (31–35) individually mounting the flaps for rotation about axes perpendicular to said direction of transport, and drive means (8, 80–86) coupled to the flaps for briefly and simultaneously rotatably swinging the flaps about said axes in a direction toward the collecting chamber to individually displace conveyed objects from the transport means into the collecting chamber and to thereafter return the flaps to a rest position whereat they are parallel to the direction of transport.

2. An apparatus according to claim 1, wherein said first plurality of flaps are located adjacent an upper part of the collecting chamber, and further comprising a second plurality of flaps, similar to the first plurality of flaps and sequentially disposed in the direction of transport and beneath the first plurality of flaps, said second plurality of flaps being coupled to said mounting means and drive means for synchronous rotation with the first plurality of flaps.

3. An apparatus according to claim 2, wherein said mounting means comprises a plurality of rotatable shafts (31–35) common to the first and second pluralities of flaps.

4. An apparatus according to claim 3, wherein the transport means comprises a first endless belt (21) arranged to pass between the first and second pluralities of flaps close to said rotatable shafts; and a second endless belt (22) arranged to pass through an aperture (60) in a guide plate (6) disposed at an input side of the collecting chamber for guiding said objects, the mutual co-action of the second belt (22) with the first belt (21) ceasing at said input side and said second belt (22) thereafter being diverted away from the collecting chamber.

5. An apparatus according to claim 1, further comprising control means (9, 10) coupled to the drive means for swinging the flaps toward the collecting chamber at a point in time at which about 4/5ths of an incoming object is located in the collecting chamber.

6. An apparatus according to claim 5, wherein the control means swings the flaps at a second point in time into the collecting chamber, irrespective of the presence or absence of an object, the interval between the first point in time and the second point in time being equal to a predetermined value.

7. An apparatus according to claim 4, wherein the guide plate (6) and a first roller (72), for guiding the two belts (21,22) and having a rotation axis perpendicular to the direction of transport, together define a longitudinally extending inward or outward bulge in the direction of transport; and a second roller (71) has an outward or inward bulge complementary to that of said first roller (72) to corrugate the object slightly upon its transport into the collecting chamber.

8. An apparatus according to claim 1, wherein the collecting chamber includes a wall (11) inclined slightly to a vertical plane and against which the objects are displaced by the flaps, and further includes a bottom (12) rotatable upwardly towards the inclined wall and which, in its upwardly rotated position, forms a wall in the collecting chamber opposed to the inclined wall.

9. An apparatus according to claim 2 or claim 3, wherein the second plurality of flaps are of similar configuration to the first plurality of flaps but smaller.

* * * * *